252-99 AU 166 EX

10/5/82 XR 4,352,678

United States Patent [19]

Jones et al.

[11] 4,352,678

[45] Oct. 5, 1982

[54] THICKENED ABRASIVE BLEACHING COMPOSITIONS

[75] Inventors: Robert A. Jones, Wirral, England; David A. Reed, La Chapelle d'Armentieres, France

[73] Assignee: Lever Brothers Company, New York, N.Y.

[21] Appl. No.: 78,103

[22] Filed: Sep. 24, 1979

[30] Foreign Application Priority Data

Oct. 2, 1978 [GB] United Kingdom ..... 38961/78

[51] Int. Cl.[3] ..... B24D 3/02

[52] U.S. Cl. ..... 51/307; 252/140; 252/528; 252/95; 252/99; 252/174.14; 252/102

[58] Field of Search ..... 51/304, 303, 305, 306, 51/307; 252/89, 82, 86, 87, 132, 136, 140, 116, 528, 95, 174.25, 174.14, 99, 102, 547

[56] References Cited

U.S. PATENT DOCUMENTS

| | | | |
|---|---|---|---|
| 3,540,891 | 11/1970 | Muhler | 51/304 |
| 3,579,456 | 5/1971 | Cambre | 252/140 |
| 3,623,990 | 11/1971 | Cambre | 252/526 |
| 3,630,922 | 12/1971 | McClain et al. | 252/99 |
| 3,754,941 | 8/1973 | Burke | 51/308 |
| 4,035,163 | 7/1977 | McLaughlin et al. | 51/308 |
| 4,122,025 | 10/1978 | Kiewert et al. | 51/308 |
| 4,129,423 | 12/1978 | Rubin | 51/304 |

FOREIGN PATENT DOCUMENTS

| | | |
|---|---|---|
| 1418671 | 12/1975 | United Kingdom . |
| 1437857 | 6/1976 | United Kingdom . |
| 1495549 | 12/1977 | United Kingdom . |
| 1511026 | 5/1978 | United Kingdom . |
| 1534680 | 12/1978 | United Kingdom . |

*Primary Examiner*—James H. Derrington

[57] ABSTRACT

A pourable scouring cleanser composition contains:

(1) an anionic surfactant preferably in an amount of 0.1 to 0.5 moles/kg;

(2) a water-soluble polar nonionic/zwitterionic surfactant in the form of an amine oxide or a betaine;

(3) an electrolyte such as sodium chloride or sodium carbonate;

(4) a chlorine-releasing bleaching agent, preferably sodium hypochlorite solution;

(5) a suspended particulate abrasive, preferably calcite.

10 Claims, No Drawings

THICKENED ABRASIVE BLEACHING COMPOSITIONS

This invention relates to pourable scouring cleanser compositions.

Pourable scouring cleanser compositions are described in our British Pat. No. 1,418,671. Whilst the compositions described therein are satisfactory they have certain disadvantages. The first of these is that they are extremely viscous and cohesive. This results in the compositions being somewhat awkward to dispense and also exhibiting poor dispersibility in water.

The essential feature of the compositions of British Pat. No. 1,418,671 is the presence of a three dimensional network of entangled filaments dispersed in an aqueous medium, which serves to maintain a particulate abrasive in suspension. In most formulations illustrated in the patent specification, the network of entangled filaments is formed by a soap and the presence of this soap has a number of consequences which we now consider as not necessarily desirable in all circumstances. In the first place, since soap acts as a depressant to the foam produced by anionic surfactants, the foaming capability of the patented compositions containing soap is low. In the second place the presence of soap filaments can act to depress the cleaning capability of the compositions. Thirdly, the production of aqueous media containing a filament network consisting of soap inevitably involves a crystallisation step, which is a difficult step to control in a factory environment.

A still further difficulty of the composition which we proposed previously is that although they are physically and chemically stable at the sort of temperatures normally encountered in northern Europe, they do not exhibit sufficient long-term stability at high temperatures to enable them to be sold with confidence in the warmer countries of southern Europe, the southern United States and South America.

The background to the present invention can therefore be summarised by saying that a generally satisfactory product had been developed but that certain difficulties had become apparent which, it was felt, could be susceptible to further research work. A programme was therefore set up with the objective of producing a scouring cleanser composition having the same general character as the composition described in U.S. Pat. No. 1,418,617, that is to say it should be a pourable composition containing a permanently suspended particulate abrasive and a chlorine bleaching agent, which did not exhibit the disadvantages described. The invention which is about to be described is a result of that work.

The most serious of the problems enumerated was that of the viscosity and cohesiveness of the patented compositions. Two approaches to this were tried. In the first approach the network of entangled filaments was omitted from the composition. This resulted in a reduction in viscosity and cohesiveness, but also in a general reduction in physical stability. This approach was therefore rejected. Secondly, the whole composition was diluted with water. This also reduced the viscosity and cohesiveness but adversely affected the general physical stability. It was therefore decided to change the composition radically so that the suspending capability was obtained without the use of an entangled network of filaments.

Accordingly, the present invention provides a pourable scouring cleanser composition comprising (i) as an anionic surfactant, an alkyl benzene sulphonate, or more preferably a primary or secondary alkyl sulphate or alkane sulphonate;

(ii) as a water-soluble polar nonionic/zwitterionic surfactant, an amine oxide or a betaine;

(iii) an electrolyte;

(iv) a chlorine-releasing bleaching agent; and (v) a suspended particulate abrasive.

The relative proportions of the anionic surfactant, the polar nonionic surfactant and the electrolyte in the liquid portion of the composition are selected in accordance with the procedure described immediately below in order to secure chemical and physical stability.

The composition to be tested is prepared, omitting the particulate abrasive and any other component which is intended to be suspended, so that the composition is transparent. It is then placed in a sealed jar and in the first stage of the test it is shaken in order to introduce air bubbles.

Bubbles of various sizes will be obtained in this way, but for the purposes of this test only the smaller ones of about ¼ mm in diameter are considered.

Compositions in accordance with this invention are capable of retaining these smaller air bubbles within the body of the fluid for a period of three weeks. Other compositions outside the scope of this invention will not show this capability, but on the contrary will permit the bubbles to move upward during the same period. This movement is easily seen since it results in a clear layer forming at the bottom of the jar.

Thus, after the relatively short period of three weeks, it is possible to determine whether a particular composition is likely to be capable of suspending abrasive, and by varying any of the factors characterising the composition it is possible to determine this for a number of similar but different compositions, and thereby indicate the region in which success is likely.

However, this first stage only provides a coarse selection, since the important question is whether the composition will suspend abrasive rather than air bubbles. Therefore the second stage of the test is to formulate the chosen composition fully, including the abrasive and any other components to be suspended, and to subject these fully formulated compositions to storage testing. Whether the composition will be capable of suspending abrasive will depend to a certain extent on the density of the abrasive and the amount of it present.

Compositions in accordance with our invention suspend abrasive, without allowing a layer of unsuspended material to settle, for 1 month, preferably 3 months at 37° C.

This two stage test selects from within the general composition set out above, those fully formulated compositions which will meet the objectives which we have set ourselves. However, it can be said that the general level of the components of the composition will be as follows. The total surfactant concentration will be of the order of from 0.1 to 0.5 moles/kg, preferably 0.2 to 0.35 mole/kg based on the liquid portion of the composition only. The molar ratio anionic surfactant:water-soluble polar nonionic/zwitterionic surfactant will be generally from 60:40 to 20:80, preferably 50:50 to 30:70.

The general level of electrolyte is less easy to indicate since it varies so much between different electrolytes and different surface active species, but for sodium chloride, which is the electrolyte with which we have most experience, the general level will be from 2 to 25%, preferably 5–20% by weight of the liquid portion of the composition.

We wish to emphasize that the test procedure described above will select different relative proportions from the procedure described at page 3, line 100 to page 4, line 2 of British Pat. No. 1,418,671. In other words, the liquid portions of the composition, by which we mean the total compositions less the abrasive in the present case, and less the abrasive and the filaments in the case of the compositions of British Pat. No. 1,418,671, are different. To particularise, the prior art compositions are not capable of suspending particulate abrasives in the absence of a network of entangled filaments.

The anionic surfactants and the water-soluble polar nonionic/zwitterionic surfactants have been specially selected to be particularly resistant to oxidation by chlorine releasing bleaching agents. Had oxidation-susceptible species such as ethoxylated nonionic surfactants been specified the composition would have been very unstable and would have had very little bleaching power after a period of storage. The chemical stability of the compositions and in particular the stability to oxidation by the chlorine-releasing bleaching agent also depends on the relative proportions of the anionic surfactant, the water-soluble polar nonionic surfactant and the electrolyte, so that a further selection must be made on this basis.

The composition to be tested is subjected to an initial titration to determine 'available chlorine'. The method used is as described in Vogel's 'Quantitative Inorganic Analysis', the standard textbook on the subject. The composition is then stored in a sealed jar at 50° C. and aliquots are removed for further titration at intervals.

Compositions in accordance with our invention show a loss of no more than half the initial available chlorine in a storage period of 30 hours.

The above storage test, it must be appreciated, is an extremely severe one, it having been deliberately accelerated to increase practicability. A half-life of 30 hours at 50° C. is equivalent to one of about a month at room temperature.

Preferred anionic surfactants are sodium $C_{12}$ to $C_{18}$ alkyl sulphates and $C_{12}$ to $C_{18}$ secondary alkane sulphonates, particularly straight chain alkyl sulphates. Preferred polar nonionic/zwitterionic surfactants are amine oxides, particularly $C_{10}$ to $C_{18}$ alkyl dimethyl amine oxides such as coconut alkyl dimethyl amine oxide.

By 'electrolyte' is meant a substance that dissolves in water to provide uni- or multivalent ions, but excluding surface-active organic compounds. Normally the electrolyte will be an inorganic compound, for instance a salt. Suitable inorganic electrolytes are those providing sodium, potassium, calcium and magnesium ions, for example sodium hydoxide, sodium chloride, sodium bromide, sodium hypochlorite, sodium carbonate, sodium sulphate, tripotassium orthophosphate, trisodium orthophosphate, sodium tripolyphosphate and calcium chloride. Sodium acetate and short-chain aromatic derivatives such as sodium toluene sulphonate, sodium xylene sulphonate and sodium benzoate are examples or organic salts that can be used as electrolyte.

The chlorine-releasing bleaching agent can be present in the composition in an amount sufficient to provide from 0.02 to 10% available chlorine. Sodium hypochlorite is then preferred chlorine-releasing bleaching agent, which is preferably present in an amount of from 0.02 to 10% by weight, more preferably 1 to 3% based on the total composition. Where hypochlorite is present, the pH of the composition should be above 9.8 if rapid chemical decomposition and hence loss of bleaching power is to be avoided. For this reason it is preferred that the compositions are buffered at pH's of above 9.8, desirably by the addition of sparingly soluble weak alkalis such as magnesium and calcium hydroxide in amounts up to 2% by weight. These materials effectively buffer the compositions only at the pH's of 10.5 and 12.5 respectively. Wider pH control can be obtained by using soluble buffering electrolytes either instead of or in addition to the insoluble buffer.

The particulate abrasive can be any particulate solid having a Moh's hardness of from 1 to 9, preferably 2 to 6. Examples of preferred materials are calcite, dolomite, felspar, and of other possible materials, diatomaceous earth, talc, bentonite, pumice, alumina and silica. The particular size distribution of the material is preferably such that at least 70% by weight of the particles have a diameter in the range of 0.1 to 500μ. Normally the compositions will contain from 0.1 to 75% by weight of the abrasive, preferably 30 to 70% by weight.

Materials of a non-essential nature may also be present in the compositions of the invention. These include, but are not confined to, colouring materials, perfumes and encapsulated bleaches. When these are present and are dissolved in the micellar suspending system rather than suspended by it, they should be included in the composition subjected to the test procedure described above, since even small amounts of material can have an effect on the suspending characteristics of the system. Water will also be present in the compositions.

The compositions of the invention may generally be prepared by one of the following methods, the first of which we have found more suitable for preparing compositions containing alkyl sulphate salts as anionic surfactants and the second of which has been found more suitable for preparing compositions containing alkyl sulphonate and alkyl benzene sulphonate salts.

(A) The electrolyte is dissolved in water and the water-soluble non-polar nonionic surfactant/zwitterionic surfactant is added as a 30% aqueous solution. The abrasive and solid buffer used is mixed into this solution to form a slurry, which is mixed at a rate sufficient to keep the abrasive in suspension without causing undue aeration. The anionic surfactant is then added as a 20% solution followed by the bleaching agent and the perfume and the composition is mixed gently to ensure homogeneity.

Variations on this general method can be used and, in particular, it may be desirable to apply heat, although in that case, care should be taken to ensure that the composition is cooled at least to below 40° C. before the bleaching agent and perfume are added.

(B) The electrolyte is dissolved in water, the anionic surfactant added as a 20–30% solution and the mixture is heated to 60°–70° C. The abrasive and buffer are then added to form a slurry as in method (A). When the slurry has cooled to 40° C. the bleaching agent is added, followed by a 30% aqueous solution of the water-soluble polar nonionic surfactant. The perfume is added and the mixture is stirred as in method (A) to ensure homogeneity.

The invention will be further illustrated with reference to the following examples.

| | % by weight | | | |
|---|---|---|---|---|
| | Ex. 1 | Ex. 2 | Ex. 3 | Ex. 4 |
| Sodium dodecyl sulphate | 1.73 | 1.44 | 1.73 | 1.73 |
| $C_{12}/C_{14}$ alkyl dimethyl amine oxide (30% aqueous solution) | 6.90 | 5.75 | 6.90 | 6.90 |
| Sodium chloride | 5.75 | 5.75 | — | 5.75 |
| Sodium carbonate | — | — | 5.00 | — |
| Magnesium hydroxide | 0.30 | 0.30 | 0.30 | — |
| Calcium hydroxide | — | — | — | 0.3 |
| Sodium hypochlorite solution containing 15% available chlorine | 10.50 | 7.00 | 10.50 | 10.50 |
| Perfume | 0.10 | 0.10 | 0.10 | 0.10 |
| Calcite | 49.70 | 49.70 | 49.70 | 49.70 |
| Water to | 100.00 | 100.00 | 100.00 | 100.00 |
| Available chlorine half-life (hours) | 60 | 72 | 72 | 108 |

| | % by weight | | | | | |
|---|---|---|---|---|---|---|
| | Ex. 5 | Ex. 6 | Ex. 7 | Ex. 8 | Ex. 9 | Ex. 10 |
| Sodium salt of secondary alkane sulphonate (60% aqueous solution) | 3.0 | 2.4 | 3.0 | 2.9 | 2.4 | 3.0 |
| $C_{12}/C_{14}$ alkyl dimethyl amine oxide (30% aqueous solution) | 4.8 | 5.8 | 4.8 | 6.9 | 5.8 | — |
| $C_{14}$ alkyl dimethyl amine oxide (30% aqueous solution) | — | — | — | — | — | 5.4 |
| Sodium chloride | 3.3 | 5.8 | 3.3 | — | — | 3.0 |
| Sodium sulphate | — | — | — | 4.5 | 4.5 | — |
| Magnesium hydroxide | 0.3 | 0.3 | — | 0.3 | 0.3 | 0.3 |
| Calcium hydroxide | — | — | 0.3 | — | — | — |
| Sodium hypochlorite solution containing 15% available chlorine | 7.0 | 7.0 | 7.0 | 10.5 | 10.5 | 10.5 |
| Calcite | 49.7 | 49.7 | 49.7 | 49.7 | 49.7 | 49.7 |
| Perfume | 0.1 | 0.1 | 0.1 | 0.1 | 0.1 | 0.1 |
| Water to | 100.0 | 100.0 | 100.0 | 100.0 | 100.0 | 100.0 |
| Available chlorine half-life | 90 | 72 | 216 | 55 | 62 | 100 |

| | % by weight | | | |
|---|---|---|---|---|
| | Ex. 11 | Ex. 12 | Ex. 13 | Ex. 14 |
| Sodium $C_{14}/C_{15}$ alkyl sulphate | 1.9 | 1.9 | — | — |
| Sodium $C_{10-12}$ alkyl benzene sulphonate | — | — | 1.5 | 1.3 |
| $C_{12}/C_{14}$ alkyl dimethyl amine oxide (30% aqueous solution) | 6.9 | 6.9 | 8.0 | 6.7 |
| Sodium chloride | 5.8 | 5.8 | 5.0 | 5.0 |
| Magnesium hydroxide | 0.3 | — | — | 0.3 |
| Calcium hydroxide | — | 0.3 | 0.3 | — |
| Sodium hydroxide (1 molar solution) | — | — | — | (5 mls) |
| Sodium hypochlorite solution containing 15% available chlorine | 7.0 | 7.0 | 7.0 | 7.0 |
| Calcite | 49.7 | 49.7 | 49.7 | 49.7 |
| Perfume | 0.1 | 0.1 | — | — |
| Water to | 100.0 | 100.0 | 100.0 | 100.0 |
| Available chlorine half-life (hours) | 50 | 84 | 80 | 108 |

All of the above examples, with the exception of Examples 13 and 14, have been stored for at least 6 months at room temperature (20°-22° C.) without particulate abrasive having settled.

All of the examples are known to be stable at 37° C. for at least 3 months without particulate abrasive settling.

The sodium $C_{14}/C_{15}$ alkyl sulphate was a sulphate of Dobanol 45 (registered Trade Mark) which is sold by Shell Chemicals Ltd.

The sodium salt of secondary alkane sulphonate was Hostapur SAS 60 (registered Trade Mark) sold by Farbwerke Hoechst AG, Frankfurt, West Germany.

The sodium $C_{10-12}$ alkyl benzene sulphonate was a sulphonate of Dobane 102 (registered Trade Mark) sold by Shell Chemicals Ltd.

The $C_{12}/C_{14}$ alkyl dimethyl amine oxide was Empigen OB (registered Trade Mark) sold by Albright & Wilson Ltd., Whitehaven, England.

The $C_{14}$ alkyl dimethyl amine oxide was Ammonyx MO, (registered Trade Mark) sold by Millmaster Onyx Ltd., Northampton, England.

The calcite had a mean particle diameter of 40 microns, with less than 10% by weight of the material having greater particle diameter than 100 microns.

In the following Examples 15 and 16, two formulations were made up approximating as closely as possible to formulations in the prior art.

EXAMPLE 15

| | % by weight |
|---|---|
| $C_{12/14}$ alkyl dimethyl amine oxide | 6.12 |
| Sodium $C_{10-12}$ alkyl benzene sulphonate | 3.90 |
| Sodium hypochlorite solution containing 15% available chlorine | 7.00 |
| Tetra potassium pyrophosphate | 10.00 |
| Ethanol | 5.00 |
| Water | to 100.00 |

This formulation is extremely similar to Sample 4 of Example 1 of U.S. Pat. No. 3,813,349. The disclosure of that patent includes statements that both abrasives and bleaches can be contained in the formulations. However, when we added finely divided calcite, in accordance with the specification quoted above, to the formulation it was not suspended but fell to the bottom of the flask in a layer.

The bleach half-life, determined in accordance with our test procedure set out above, was only 10 hours even at room temperature.

EXAMPLE 16

| | % by weight |
|---|---|
| Oxalic acid | 2.0 |
| Sodium oxalate | 2.0 |
| Sodium $C_{10-12}$ alkyl benzene sulphonate | 5.0 |
| $C_{12}$ alkyl dimethyl ammonium sulphobetaine | 5.0 |
| Water | to 100.0 |

The above formulation is extremely similar to that given in the example in U.S. Pat. No. 3,579,456.

The components were mixed as directed, but when it was attempted to add a solution of sodium hypochlorite to the mixture there was a violent reaction, with evolution of gas and heavy foaming.

What we claim is:

1. A pourable aqueous scouring cleanser composition free from a three dimensional network of entanged filaments, said composition comprising:

(i) in a liquid portion, (a) from 0.02 to 10% by weight based on the total composition of sodium hypochlorite as a chlorine-releasing bleaching agent; and (b) a suspending combination of from 0.1 to 0.5 moles/kg, based on the weight of the liquid portion of an anionic surfactant and a water soluble polar nonionic/zwitterionic surfactant in the form of an amine oxide and an effective amount of electrolyte in aqueous solution to form said suspending combination, said suspending combination being resistant to oxidative chlorination by said chlorine-releasing bleaching agent; and (ii) from 0.1 to 75% by weight of a particulate abrasive suspended in said suspending combination, said liquid portion and particulate abrasive when combined providing said composition in a form from which there is absent any three dimensional network of entangled filaments.

2. A composition according to claim 1, wherein the anionic surfactant comprises a primary or secondary alkyl sulphate.

3. A composition according to claim 1, wherein the anionic surfactant comprises an alkyl benzene sulphonate.

4. A composition according to claim 1, wherein the anionic surfactant comprises a secondary alkyl sulphonate.

5. A composition according to claim 1, wherein the polar nonionic/zwitterionic surfactant comprises an amine oxide.

6. A composition according to claim 1, wherein the electrolyte comprises sodium chloride or sodium carbonate.

7. A composition according to claim 1, wherein the suspended particulate abrasive comprises calcite.

8. A composition according to claim 1, wherein the total surfactant concentration is 0.1 to 0.5 moles/kg based on the composition less abrasive.

9. A composition according to claim 1, wherein the total surfactant concentration is 0.2 to 0.35 moles/kg based on the composition less abrasive.

10. A composition according to claim 1, wherein the molar ratio anionic surfactant:water-soluble polar nonionic/zwitterionic surfactant is from 60:40 to 20:80.

* * * * *